US005503674A

United States Patent [19]

Hofmann et al.

[11] Patent Number: 5,503,674

[45] Date of Patent: Apr. 2, 1996

[54] CONVERTIBLE OR SHIFTABLE VARNISH SUPPLY ON FINISHING UNITS IN ROTARY PRINTING PRESSES

[75] Inventors: Günther Hofmann, Walldorf; Rudolf Leib, Nussloch, both of Germany

[73] Assignee: Heidelberger Druckmaschinen Aktiengesellschaft, Heidelberg, Germany

[21] Appl. No.: 230,322

[22] Filed: Apr. 20, 1994

[30] Foreign Application Priority Data

Apr. 20, 1993 [DE] Germany ..... 43 12 877.7

[51] Int. Cl.[6] ..... B05C 1/08

[52] U.S. Cl. ..... 118/46; 118/110; 118/118; 118/122; 118/123; 118/249; 118/262; 101/148; 101/350; 101/363

[58] Field of Search ..... 118/110, 118, 118/122, 123, 231, 249, 258, 262, 263, 46; 101/350, 363, 148, 351

[56] References Cited

U.S. PATENT DOCUMENTS

| | | | |
|---|---|---|---|
| 3,603,254 | 9/1971 | Siebke | 101/148 |
| 4,046,931 | 9/1977 | Innes et al. | 427/428 |
| 4,181,076 | 1/1980 | Gattus | 101/363 |
| 4,372,244 | 2/1983 | Rebel | 118/46 |
| 4,466,347 | 8/1984 | Difflipp et al. | 101/148 |
| 4,569,306 | 2/1986 | Ito et al. | 118/249 |
| 4,603,633 | 8/1986 | Schubert et al. | 101/366 |
| 4,815,413 | 3/1989 | Kota | 118/249 |
| 5,002,007 | 3/1991 | Jahn | 118/249 |
| 5,048,453 | 9/1991 | Eriksson | 118/258 |
| 5,063,844 | 11/1991 | Fansel | 101/148 |
| 5,170,706 | 12/1992 | Rodi et al. | 101/350 |

FOREIGN PATENT DOCUMENTS

| | | |
|---|---|---|
| 3427898 | 11/1985 | Germany . |
| 3906648 | 10/1989 | Germany . |

*Primary Examiner*—Laura Collins

*Attorney, Agent, or Firm*—Herbert L. Lerner; Laurence A. Greenberg

[57] ABSTRACT

Device for processing a viscous fluid for finishing printing products in a finishing unit of a rotary printing press, the finishing unit having a plurality of rollers suppliable with the fluid at least at one feeding location thereof, and a plurality of cylinders suppliable with the fluid by the plurality of rollers, includes a device for collecting the fluid from the one feeding location thereof, the plurality of rollers including a metering roller engageable with one of the cylinders for feeding the fluid thereto, another roller of the plurality of rollers being in cooperative engagement with the metering roller and with the collecting device for feeding the fluid to the metering roller.

9 Claims, 3 Drawing Sheets

CONVERTIBLE OR SHIFTABLE VARNISH SUPPLY ON FINISHING UNITS IN ROTARY PRINTING PRESSES

BACKGROUND OF THE INVENTION

FIELD OF THE INVENTION

The invention relates to a device for processing viscous or highly viscous fluids, for finishing printing products in a finishing unit on a rotary printing press, the finishing unit having a plurality of rollers suppliable at least at one supply location, as well as cylinders suppliable thereby.

From the state of the art, coating units for highly viscous, oil-bearing or low-viscous materials have become known heretofore. Published German Patent Document DE 39 06 648 A1 discloses a coating unit for printing presses. The coating unit described therein operates in accordance with the dip roller principle. A dip roller dipping into a liquid container has a doctor blade assigned thereto which removes from the circumference of the dip roller that part of the liquid which is not accepted or taken up by the cells of the dip roller. A disadvantage connected with the dip roller principle lies in the great effort which must be expended to circulate highly viscous varnish completely. This requires a special trough or tray construction matching or accommodated to the respective highly viscous fluid which is to be processed.

Published German Patent Document DE 34 27 898 C1 discloses a device for applying or coating liquid, particularly a varnishing unit for a printing press. In this construction according to the state of the art, baffle plates are arranged in the nip region of roller pairs and have individual channels connecting the nip regions to one another.

Starting from the state of the art, it is an object of the invention of the instant application to provide a convertible or shiftable varnish supply in finishing units on rotary printing presses which permits the processing of fluids suitable for finishing which have a spectrum which is as broadbanded as possible.

SUMMARY OF THE INVENTION

With the foregoing and other objects in view, there is provided, in accordance with the invention, a device for processing a viscous fluid for finishing printing products in a finishing unit of a rotary printing press, the finishing unit having a plurality of rollers suppliable with the fluid at least at one feeding location thereof, and a plurality of cylinders suppliable with the fluid by the plurality of rollers, comprising means for collecting the fluid from the one feeding location thereof, the plurality of rollers including a metering roller engageable with one of the cylinders for feeding the fluid thereto, another roller of the plurality of rollers being in cooperative engagement with the metering roller and with the collecting means for feeding the fluid to the metering roller.

In accordance with another feature of the invention, the collecting means comprise a varnish trough, and the metering roller is engageable with another of the plurality of rollers which is swivellable into a position wherein it is in engagement with the metering roller and with varnish in the varnish trough.

In accordance with a further feature of the invention, the collecting means comprise a varnish trough, and the metering roller is engageable with another of the plurality of rollers forming a stationarily mounted varnish feed roller engaging the metering roller and varnish in the varnish trough.

In accordance with an added feature of the invention, the collecting means comprise a roller wedge disposed between and defined by the metering roller and another of the plurality of rollers which is swivellable into a position wherein it is in engagement with the metering roller.

In accordance with an alternative feature of the invention, the collecting means comprise a roller wedge disposed between and defined by the metering roller and another of the plurality of rollers which is stationarily mounted in a position wherein it is in engagement with the metering roller.

In accordance with an additional feature of the invention, the metering roller is displaceable along an adjustment path between two stationarily arranged rollers of the plurality of rollers.

In accordance with yet another feature of the invention, one of the stationarily arranged rollers is a squeeze roller, the metering roller, in a position thereof along the adjustment path, defining with the squeeze roller a roller wedge, and including another fluid feeding location disposed above the roller wedge.

In accordance with yet a further feature of the invention, one of the stationarily arranged rollers is a feed roller, and including fluid collector plates arranged cascadingly below the feed roller.

In accordance with yet an added feature of the invention, one of the plurality of rollers is a metering roller, and one of the plurality of cylinders is a varnish blanket cylinder in contact engagement with a plate cylinder of the printing press, the metering roller being swivellable into a position wherein it is in engagement with the plate cylinder and indirectly therethrough with the varnish blanket cylinder for performing an indirect varnish application.

In accordance with yet an additional feature of the invention, the metering roller is stationarily mounted, the other of the plurality of rollers is a squeeze roller, and the plurality of rollers also include a feed roller which is reversible in rotational direction.

In accordance with another feature of the invention, the other of the plurality of rollers is a rubber roller assigned to the metering roller and swivellable in common with a varnish feed pipe at the one feeding location into respective first and second positions at substantially opposite locations of the metering roller.

In accordance with a further feature of the invention, the rubber roller and the varnish feed pipe are swivellable over respective, substantially semicircular swivel paths.

In accordance with an added feature of the invention, the rubber roller and the varnish feed pipe which are swivellable in common are convertible with respect to the metering roller in the first and in the second positions thereof.

In accordance with a concomitant feature of the invention, the collecting means include at least one varnish trough and at least one roller wedge defined by wedge elements, the varnish trough and the wedge elements being stationarily mounted in side walls of the finishing unit.

An advantage of the foregoing constructions according to the invention is that the selection of the optimum conveying principle for the processing of the surface of the printing material can be made in accordance with the rheological properties of the fluid finishing the surface of the printing material. The only requirement for this purpose is either a swivelling of the metering roller or a swivelling of a roller into another position; in this way, both the dip roller principle as well as the roller wedge principle may be realized in a compact manner of construction. In accordance with other inventive features, the metering roller is displaced along an adjustment path between two stationarily arranged rollers. An indirect application of the finishing fluid via one of the fluid-conducting cylinders is thereby possible in the plate cylinder. Furthermore, a second varnish feed pipe is arranged above a roller wedge formed between the metering roller and a squeeze roller, due to which a varnish supply provided as closely as possible to the roller wedge is assured. With the collecting plates arranged box-like below a feed roller, an intermixing of the excess fluid can be achieved.

In another configuration of the finishing unit, both a squeeze roller and a feed roller reversible in direction of rotation are associated with a stationarily mounted metering roller. When the feed roller is rotated clockwise, the finishing fluid is conveyed out of a trough; when the feed roller is rotated counter-clockwise, the varnish supply via a varnish feed pipe disposed above the feed roller is assured.

Yet another configuration of the finishing unit is provided, in that a rubber roller associated with the metering roller is swivellable jointly with a varnish feed pipe into a first and into a second position. Besides the swivelling capability of the rubber roller and the varnish feed pipe, they can both obviously also be converted or transferred into the different positions manually. With this configuration, a separate squeeze roller may be dispensed with, because such a roller is formed by the rubber roller limiting or defining the roller wedge in the second position.

Other features which are considered as characteristic for the invention are set forth in the appended claims.

Although the invention is illustrated and described herein as embodied in a convertible varnish supply in finishing units on rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENT

Figure 1:
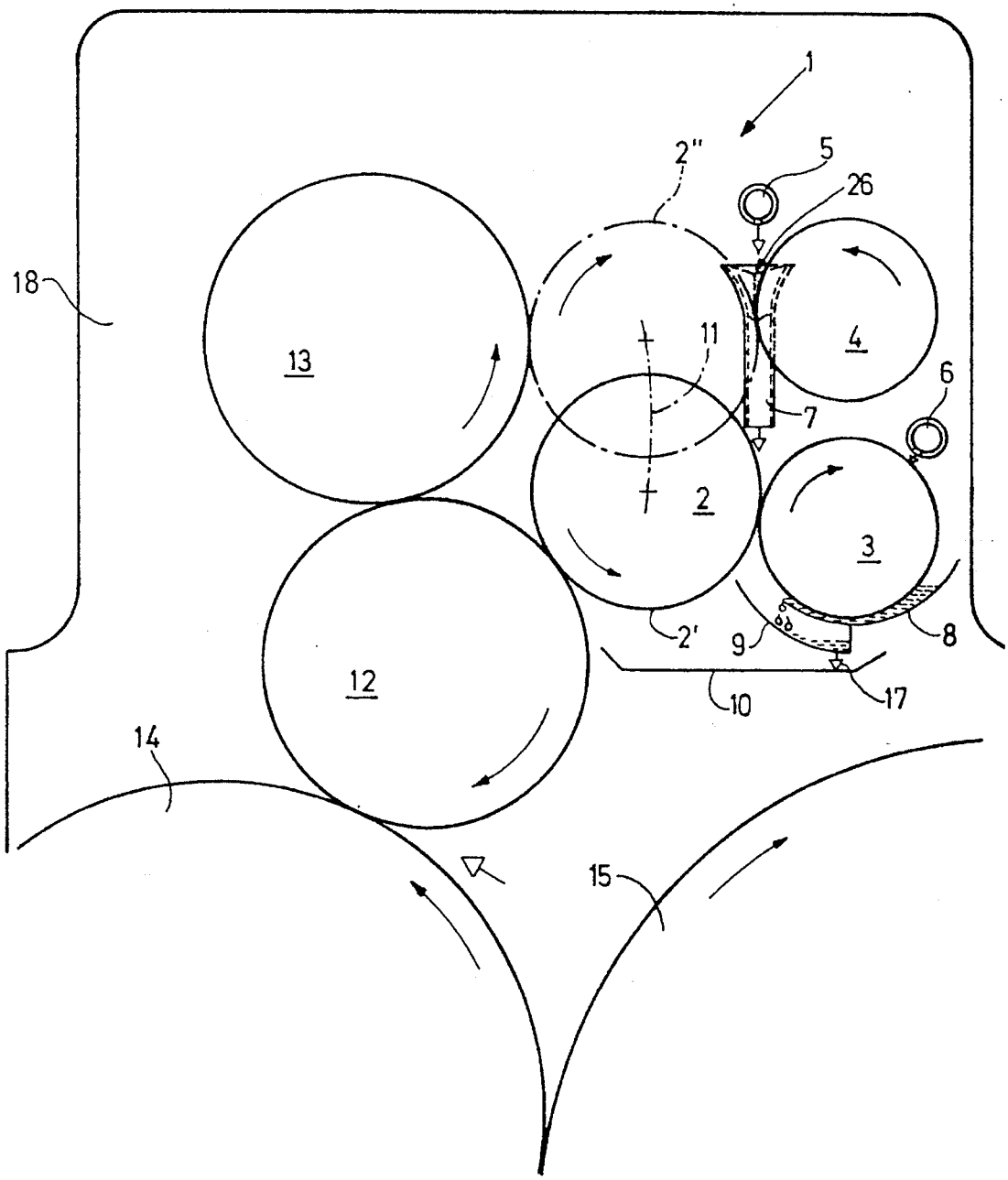
FIG. 1 is a fragmentary, diagrammatic side elevational view of a rotary printing press having a first embodiment of a finishing unit with a swivellable metering roller engageable with stationarily mounted rollers.

Referring now to the drawings and, first, particularly to FIG. 1 thereof, there is shown therein a finishing unit 1 having a metering roller 2 swivellable into positions 2' and 2" thereof, respectively shown with a solid line and in phantom. The metering roller 2 swivels along an adjusting path 11. The metering roller 2 is engageable with both a feed roller 3 and a squeeze roller 4. Above the squeeze roller 4 and wedge elements 7 disposed at opposite ends of the squeeze roller 4 so as to define a wedge-shaped region or roller wedge 26 formed between the squeeze roller 4 and the metering roller 2 when it is in the position 2" thereof is a varnish feed pipe 5, and above the feed roller 3 is another varnish feed pipe 6. Collector plates 8 and 9 are fastened below the feed roller 3 in a cascading staggered form, and below which, in turn, a varnish trough or tray 10 is disposed, extending to a varnish blanket cylinder 12. Above the varnish blanket cylinder 12 is a plate cylinder 13 via which an indirect application or coating of varnish can be effected when the metering roller 2 is swivelled into the position 2" thereof. Below the varnish-conducting cylinders 12 and 13, is an impression cylinder 14 on which printing sheets which are to be finished are transferred from a transfer drum 15.

The impression cylinder 14 and the transfer drum 15 may be referred to as sheet-guiding cylinders.

As noted hereinbefore, when the metering roller 2 is swivelled into the position 2" thereof, a roller wedge 26 is formed between the metering roller 2 and the squeeze roller 4 mounted stationarily in side walls 18 of the printing-press finishing unit. The varnish feed pipe 5 supplies the roller wedge 26 with varnish, so that the plate cylinder 13 is supplied with varnish. With this indirect varnish-coating mode of operation, the varnish blanket cylinder 12 is supplied with varnish by the plate cylinder 13 and, in turn, finishes the printing sheet disposed on the circumference of the impression cylinder 14 which has a diameter which is a multiple in length of the diameter of the blanket and plate cylinders 12 and 13.

If the metering roller 2 has been swivelled into the position 2' thereof, on the other hand, it is in contact with the roller surface of the feed roller 3. The fluid finishing the printing product can be fed through a varnish feed pipe 6 to the feed roller 3. Varnish take-up or acceptance is likewise possible from the collector plate 8 below which another collector plate 9 with a sheet-shaped contour is disposed. The metering roller 2 engaging the feed roller 3 stationarily mounted in the side walls 18 of the finishing unit removes the fluid from the jacket of the feed roller 3 and carries it in the path of the direct varnish application via the varnish blanket cylinder 12 so as to apply it to or coat it on the printing product to be finished. A varnish trough or tray 10 extends below the metering roller 2 swivelled into the position 2" thereof and below the collector plates 8 and 9, and protects the printing product conveyed by the transfer drum 15 onto the circumference of the impression cylinder 14 against any spattering.

Figure 2:
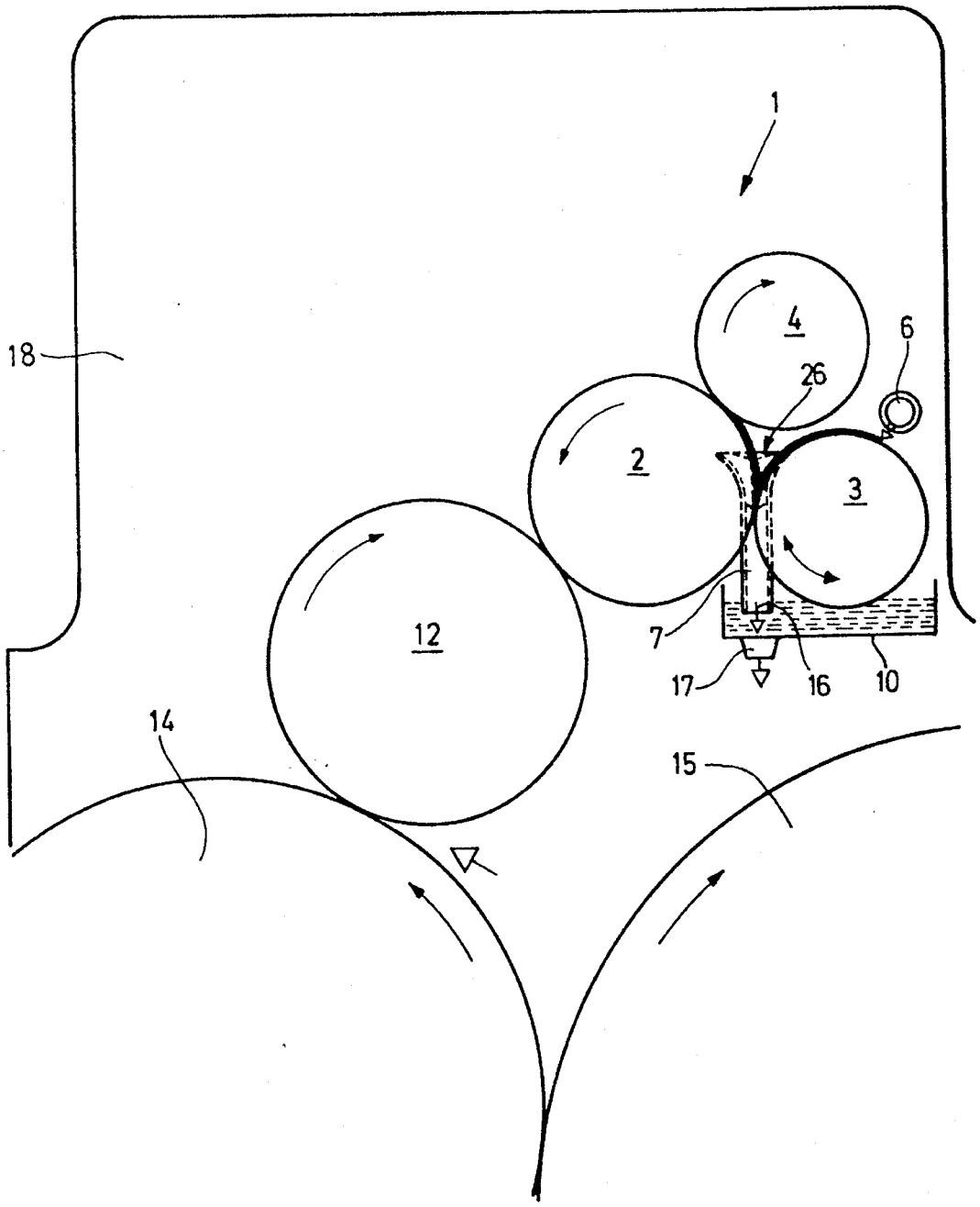
FIG. 2 is a view like that of FIG. 1 of the rotary printing press having a second embodiment of the finishing unit which is of different configuration and is provided with supply rollers which are drivable in either direction of rotation.

FIG. 2 illustrates a configuration of the finishing unit wherein a feed roller is drivable in two directions. In this configuration, the feed roller 3, the squeeze roller 4, the metering roller 2 and the varnish blanket cylinder 12 are stationarily mounted in the side walls 18. Analogous to the representation in FIG. 1, a varnish feed pipe 6 is disposed above the feed roller 3, and a varnish trough or tray 10 is disposed below the feed roller 3. Wedge elements 7 laterally limiting or defining the roller wedge 26 form a varnish inlet 16 to the varnish trough or tray 10 for conducting excess fluid into the varnish trough or tray 10. The varnish trough or tray discharges its contents through a varnish outlet or drain 17. When the feed roller 3 is rotated in clockwise direction, as viewed in FIG. 2, it conveys, out of the varnish trough or tray 10, fluid which, via the metering roller 2, is applied to or coated on the covering of the varnish blanket cylinder 12, whether it is a rubber blanket for full-surface varnishing, or a varnish plate for varnishing selected surfaces. If the feed roller 3, on the other hand, were driven counter-clockwise, fluid coming out of the varnish feed pipe 6 would be conveyed via the feed roller 3 into the roller wedge 26. Excess fluid is reconducted by the squeeze roller 4 into the roller wedge 26, from which it is fed to the varnish trough or tray 10 via the wedge elements 7 laterally defining or limiting the roller wedge 26. Analogously to the embodiment illustrated in FIG. 1, the impression cylinder 14 and the transfer cylinder 15 are located below the finishing unit 1, and the printing copies to be finished are transported thereby.

Figure 3:
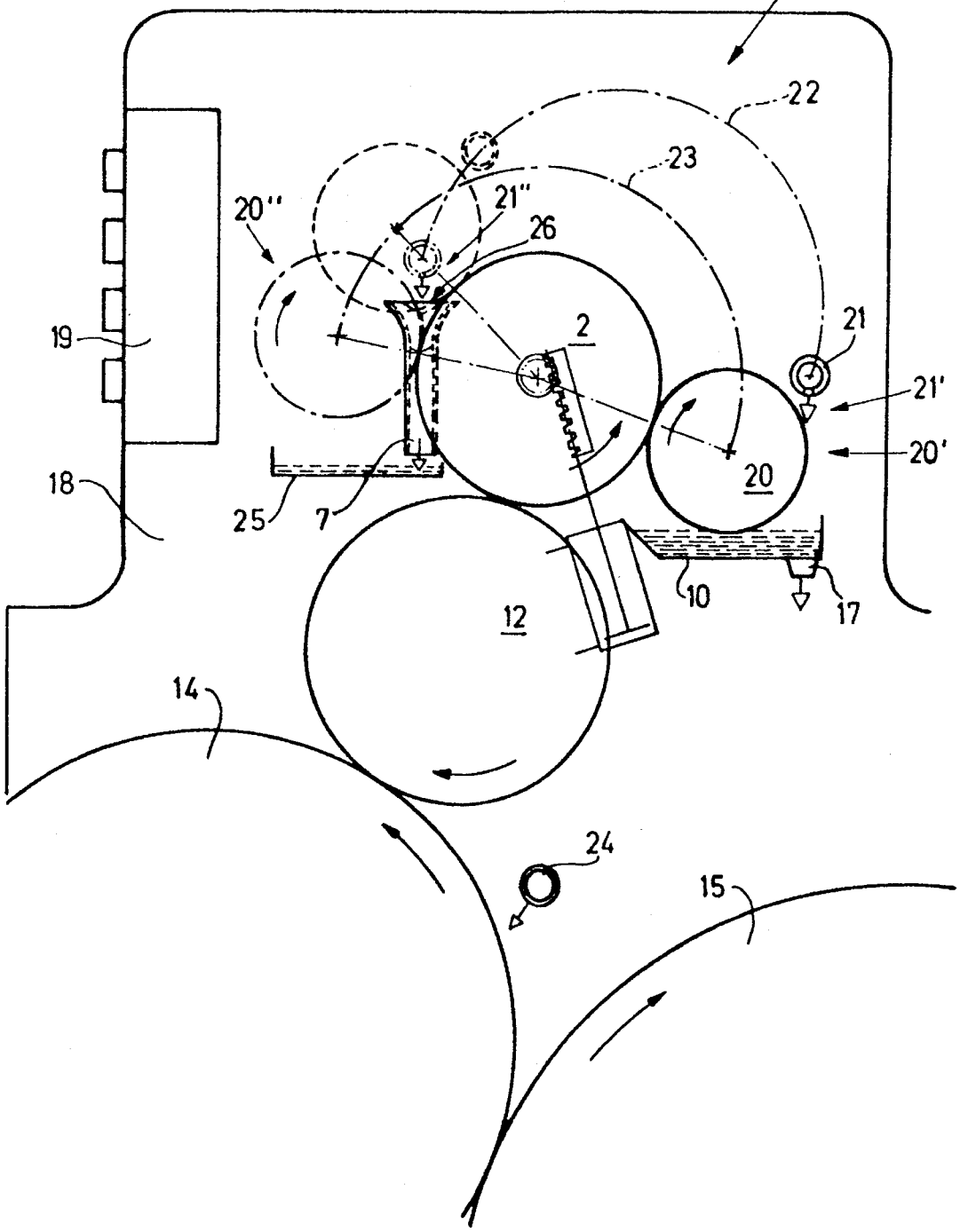
FIG. 3 is a view like those of FIGS. 1 and 2 of the printing press having a third embodiment of the finishing unit with a blanket roller assigned to a metering roller and swivellable between two positions.

FIG. 3 shows a finishing unit with a blanket cylinder swivellable between two positions and assigned to a metering roller.

The metering roller 2 and the varnish blanket cylinder 12 are stationarily mounted In the side walls 18 of the finishing unit 1. Sheet-guiding cylinders 14 and 15 are arranged under the metering roller 2 and the varnish blanket cylinder 12 in a manner analogous to the aforedescribed configurations illustrated in FIGS. 1 and 2. In contrast therewith, however, in the embodiment of FIG. 3, a blast bar 24 extending in axial direction is disposed above the impression cylinder 14 and assures a smooth contact engagement, on the surface of the impression cylinder 14, of the printing product to be finished. This is of importance, especially, for improving the capability of register maintenance of bending-resistant cardboard sheets.

A rubber roller 20 is assigned to the metering roller 2 and is swivellable into a first position 20' and a second position 20" thereof. A varnish feed pipe 21 is disposed above the swivellable rubber roller 20 and is likewise swivellable between a first position 21' and a second position 21". The varnish feed pipe 21 describes a semicircular swivel path 22 during the movement thereof, while the rubber roller 20 describes a semicircular swivel path 23. A varnish trough 25, wedge elements 7 on both sides of the roller wedge 26, and a varnish trough 10 underneath the first position 20' of the rubber roller 20 are stationarily mounted in the side walls 18. When the rubber roller 20 is swivelled into the position 20' thereof, varnish is supplied in accordance with the dip roller principle. Control of the quantity of varnish to be applied to the metering roller 2 is achievable through the immersion depth of the rubber roller 20 determined with the position 20' thereof. The varnish application occurs in the position 20' on the surface of the metering roller 2 from there onto the varnish blanket cylinder 12 finishing the surface of the printing material.

When the rubber roller 20 has swivelled into the position 20" thereof, a roller wedge 26 is formed between the surface of the metering roller 2 and the surface of the rubber roller 20 and is defined by wedge elements 7 fixedly mounted on the side walls 18. Excess quantities of fluid are discharged into the varnish trough 25. The swivelling of the rubber roller 20 together with the supplying of varnish through the feed pipe 21 is effected by controlling the respective drive by means of an operator control panel or keyboard 19.

Besides the motorized swivelling of the rubber roller 20 into the positions 20' and 20" a manual conversion both of the varnish feed pipe 21, as well as the rubber roller 20 in the respective other position is possible. It is also conceivable to assign two varnish-conducting rubber rollers 20 into the positions 20' and 20" in order to supply the metering roller 2 with fluid.

We claim:

1. In combination, a finishing unit of a rotary printing press, the finishing unit comprising a plurality of rollers suppliable with a viscous fluid at least at one feeding location thereof, and a plurality of cylinders suppliable with the viscous fluid by the plurality of rollers, and a device for processing the viscous fluid for finishing printing products, the device comprising means for receiving the fluid at the one feeding location thereof, the plurality of rollers including a metering roller engageable with one of the cylinders for feeding the fluid thereto, another roller of the plurality of rollers being in cooperative engagement with said metering roller and with said receiving means for feeding the fluid to the metering roller, and a varnish feed pipe, the other of said plurality of rollers being a rubber roller contacting said metering roller said varnish feed pipe being disposed in fluid communication with said rubber roller whereby said rubber roller is swivellable in common with said varnish feed pipe at said one feeding location into respective first and second positions at substantially opposite locations of said metering roller.

2. The combination according to claim 1, wherein said receiving means comprise a varnish trough, and said metering roller, in a position wherein it is in engagement with one of said plurality of rollers, being in contact with varnish in said varnish trough.

3. The combination according to claim 1, wherein said receiving means further comprise a roller wedge between and defined by said metering roller and said rubber roller.

4. Device according to claim 1, wherein said rubber roller and said varnish feed pipe are swivellable over respective, substantially semicircular swivel paths.

5. The combination according to claim 1, wherein said rubber roller and said varnish feed pipe which are swivellable in common are movable with respect to said metering roller into said first and into said second positions thereof.

6. Device according to claim 1, wherein said receiving means include at least one varnish trough and at least one roller wedge defined by wedge elements, said varnish trough and said wedge elements being stationarily mounted in side walls of the finishing unit.

7. In combination, a finishing unit of a rotary printing press, the finishing unit comprising a plurality of rollers suppliable with a viscous fluid at least at one feeding location thereof, and a plurality of cylinders suppliable with the viscous fluid by the plurality of rollers, and a device for processing the viscous fluid for finishing printing products, the device comprising means for receiving the fluid at the one feeding location thereof, the plurality of rollers including a metering roller engageable with one of the cylinders for feeding the fluid thereto, another roller of the plurality of rollers being in cooperative engagement with said metering roller and with said receiving means for feeding the fluid to the metering roller, said metering roller being displaceable along an adjustment path between two stationarily arranged rollers of said plurality of rollers, wherein one of said stationarily arranged rollers is a squeeze roller, said metering roller, in a position thereof along said adjustment path, defining with said squeeze roller a roller wedge, and including another fluid feeding location disposed above said roller wedge.

8. Device according to claim 7, wherein one of said stationarily arranged rollers is a feed roller, and including fluid collector plates arranged cascadingly below said feed roller.

9. In combination, a finishing unit of a rotary printing press, the finishing unit comprising a plurality of rollers suppliable with a viscous fluid at least at one feeding location thereof, and a plurality of cylinders suppliable with the viscous fluid by the plurality of rollers, and a device for processing the viscous fluid for finishing printing products, the device comprising means for receiving the fluid at the one feeding location thereof, the plurality of rollers including a metering roller engageable with one of the cylinders for feeding the fluid thereto, another roller of the plurality of rollers being in cooperative engagement with said metering roller and with said receiving means for feeding the fluid to the metering rollers, said metering roller being displaceable along an adjustment path between two stationarily arranged rollers of said plurality of roller, wherein one of the plurality of cylinders is a varnish blanket cylinder in contact engagement with a plate cylinder of the printing press, said metering roller being swivellable into a position wherein it is in engagement with the plate cylinder and indirectly therethrough with said varnish blanket cylinder for performing an indirect varnish application.

* * * * *